US006324826B1

(12) United States Patent
Schuller et al.

(10) Patent No.: US 6,324,826 B1
(45) Date of Patent: Dec. 4, 2001

(54) GUIDE TUBE FOR THREAD

(75) Inventors: Edmund Schuller; Heinz Leipnitz, both of Ingolstadt; Romeo Pohn, Geisenfeld/Rottenegg; Josef Schermer, Bergheim-Unterstall, all of (DE)

(73) Assignee: Rieter Ingolstadt Spinnereimaschinenbau AG, Ingolstadt (DE)

( * ) Notice: Subject to any disclaimer, the term of this patent is extended or adjusted under 35 U.S.C. 154(b) by 0 days.

(21) Appl. No.: 09/537,656

(22) Filed: Mar. 29, 2000

(30) Foreign Application Priority Data

Apr. 9, 1999 (DE) ..... 199 15 924

(51) Int. Cl.[7] ..... D01H 4/40
(52) U.S. Cl. ..... 57/417
(58) Field of Search ..... 57/417, 352, 356, 57/414

(56) References Cited

U.S. PATENT DOCUMENTS

| | | | | |
|---|---|---|---|---|
| 4,078,231 | | 3/1978 | Artzt et al. . | |
| 4,499,719 | | 2/1985 | Faessler . | |
| 4,610,134 | * | 9/1986 | Busch et al. | 57/417 |
| 4,773,211 | * | 9/1988 | Stahlecker et al. | 57/417 |
| 4,829,762 | * | 5/1989 | Wassenhoven | 57/417 |
| 4,843,812 | * | 7/1989 | Raasch | 57/417 |
| 4,932,202 | * | 6/1990 | Landwehrkamp | 57/417 |
| 5,044,151 | * | 9/1991 | Pohn et al. | 57/417 |
| 5,402,630 | * | 4/1995 | Stephen et al. | 57/417 |

FOREIGN PATENT DOCUMENTS

| | | | | |
|---|---|---|---|---|
| 3940046 A1 | | 6/1991 | (DE) . | |
| 4235024 | * | 4/1994 | (DE) | 57/417 |
| 19547544 | | 6/1997 | (DE) . | |
| 0341405 A1 | | 11/1989 | (EP) . | |
| 2115840 A | | 9/1983 | (GB) . | |

OTHER PUBLICATIONS

European Patent Office Search Report, Oct. 23, 2000.
German Patent Office Search Report, Aug. 24, 1999.

* cited by examiner

*Primary Examiner*—Danny Worrell
(74) *Attorney, Agent, or Firm*—Dority & Manning, P.A.

(57) ABSTRACT

The invention concerns a thread guide tube with a passage for the guidance of a thread exiting the thread forming zone of a spinning machine. The tube possessing a first section which is proximal to the thread forming zone, and a second section which is remote from the thread forming zone. The thread guide tube has a separation so that the thread guide tube is separable and is comprised of at least two parts.

13 Claims, 2 Drawing Sheets

GUIDE TUBE FOR THREAD

BACKGROUND

The invention concerns a thread guiding element for a thread departing out of the thread forming zone of a spinning machine.

A thread guiding element of such a type has been disclosed, for instance, by DE 42 35 024 A1. This element possesses an entry area for the thread, which is proximal to the thread forming zone of the spinning machine and another area, which is remote from the said thread forming zone. These two areas are tubular in design and their axes intersect at an angle. The spun thread enters into the thread guide tube, has its direction of travel changed therein, and leaves the thread guide tube through that part mentioned which is remote from the thread forming zone. The thread guide tube is comprised of several individual parts, which are securely fastened to one another. It is a practice of the present state of the technology to bind the several individual parts firmly together by adhesive.

DE 33 32 498 A1 teaches us that a thread guide tube is known, of which that part proximal to the thread forming zone and the part thereof remote from said zone, are made together as one piece. The center axes of these two parts likewise close an angle between them. In the area of the transition of the two sections of the thread guide tube this transition possesses an insert, which forms a restraining element for the thread which is traveling through. This insert is designed to be exchangeable.

The known thread guide tubes have the disadvantage, that in practice, they are inflexible since they have a rigid arrangement of the part proximal to the thread forming zone and the part which is remote from said zone. Under these circumstances, it is not possible to manipulate these two parts independently of one another, to install, or to replace one of them.

Thus, the purpose of the invention is to design a thread guide tube in such a manner that the possibilities of its use are essentially improved, and so that it can even be adapted for other, i.e. additional purposes, and further that the disadvantages of the state of the technology are avoided. This purpose is achieved, within the framework of the invention.

SUMMARY OF THE INVENTION

Objects and advantages of the invention will be set forth in part in the following description or may be obvious from the description, or may be learned through practice of the invention.

By means of the invented arrangement of the thread guide tube with a separating feature, the advantage is achieved that the thread guide tube can be disassembled and thereby, the field of application and construction possibilities for the thread guide tube are essentially expanded. It is now possible, for instance, to so fashion the thread guide tube, that where abrasion is a problem, individual parts of the thread guide can be exchanged without the necessity that at the same time the inserts i.e. inside the thread guide tube, must also be exchanged.

Further, it is possible, for instance, to construct the thread guide tube out of various materials. New and other raw materials for different sections of the thread guide tube can be employed, making the design more versatile and economical. A further advantage of the separable sectioning is found therein that upon maintenance work on a spinning machine the thread guide tube can be taken apart, whereby a considerably simplified cleaning of the thread guide tube is possible partly because this unit no longer needs to be completely removed from the spinning apparatus. By means of the invented formulation, it is also possible to so design certain parts of the thread guide tube which are exposed to no wear, so that they practically never need to be exchanged. These parts also can be originally so constructed that they need not be replaced, since now materials can be employed which although more valuable and thus higher in price, are also characterized by an increased operative lifetime.

By the designing of the thread guide tube with a separation in the area of the second section of the thread guide tube, which is remote from the thread forming zone, a particular advantage is achieved. This occurs in that an apportionment of the thread guide tube is made separating one area which has very little wear from another area which is subject to greater wear. Because of this, a flexible design of the thread guide tube becomes possible, especially in regard to costs.

In a further advantageous embodiment of the invention, the thread guide tube in the area of the first section, which is proximal to the thread forming zone, is provided with a separating arrangement. What is achieved by this is that an easier cleaning of the thread guide tube is possible, and in some cases exchangeable inserts, for instance a restraining element in the thread guide tube for the increasing of the twisting of the thread, can be more easily exchanged.

Particularly of advantage, is that the separable point is arranged between two sections of the thread guide tube. This is particularly advantageous for cleaning. In a more favorable way the thread guide tube, at least in that area proximal to the thread forming zone, is designed as an enclosed tube whereby a particularly accurate guidance of the thread is possible.

Also, the zone remote from the thread forming zone can be equipped without any trouble to have the same advantage. Favorably, both zones of the thread guide tube have, respectively, a centerline axis which intersects at an angle. In this way it is possible to spin the threads with good characteristics. It is particularly of advantage when the thread guide tube is divided into two parts of which at least one possesses a coupling element for a mutual connection. By such a coupling element it is possible to make not only a secure connection, but one which can be easily opened.

The coupling element is particularly advantageous when designed as a bayonet or a clip-on type fastener which unite the two parts of the thread guide tube in a simple and safe manner, and which also allow an easy separation without tools. In another preferred embodiment of the thread guide tube, the connection is made by a coupling element provided with threads. The two engaging parts of the threaded connection work advantageously together in such a manner that a secure closure is made between the two parts of the thread guide tube which is easily loosened and can be easily tightened together again. In an especially advantageous development of the invention one part of the thread guide tube in the neighborhood of the separation takes the other part into its interior.

This construction assures that the two parts align themselves with one another when connected. Thus, during assembly as well as in operation, lining up the two parts with respect to each other becomes easier to carry out and good functioning is assured. At the same time the penetrative connection is more stable.

In yet another advantageous development of the invention, one of the parts of the thread guide tube carries a sensor. Because of the invented arrangement of the thread guide tube, the advantage is brought about that the sensor can be installed directly on the thread guide tube because the separative design allows, that in case of need, parts of the thread guide tube to be exchanged without simultaneously removing the sensor. It may be also advantageously arranged that the sensor itself can be replaced by another sensor without having always to switch the entire thread guide tube when this is done. Because of the arrangement of the thread guide tube, in accord with the invention, the particularly favorable possibility arises of placing a sensor on the thread guide tube without the sensor being limited by the operating life of the thread guide tube or by the parts thereof which are prone to wear. Furthermore, it is advantageously possible to place the sensor in the neighborhood of the separation so that an easy cleaning and monitoring of the sensor is possible. In an advantageous development of the invention the sensor is in the area of that section of the thread guide tube remote from the thread forming zone.

Other advantages are found in locating the sensor in the area of the thread guide tube which is proximal to the thread forming zone. In this way, it is possible to carry out a supervisory watching of the yarn at a very close location to one of the thread forming zones.

It is possible, for instance, to design the sensor to be a monitor for the quality of the thread to detect faults in either a short time, or after a short run of thread, in the thread already spun.

In a particularly favorable embodiment of the invention, the sensor is designed as a sensor for the monitoring of the channel in the interior of the thread guide tube. In this way it is advantageously achieved that, for instance, a contamination in the thread passage can be easily detected.

In an advantageous development of the invention, the sensor is designed to detect the presence of a running thread in the passage of the thread guide tube whereby a break in the thread can be quickly recognized so that the control of the spinning machine can react thereto with corresponding speed.

In an advantageous improvement of the invention, the sensor is planned to check the thickness and/or the weight of the thread. In this way it is possible to monitor the quality of the spun thread, and faults such as thick or thin places are quick to be detected. In a particularly favorable embodiment of the invention, the sensor is designed for the monitoring of the thread, particularly as a detector of foreign fibers in the thread. In this way it is possible to produce a highly valuable, high quality thread since quick reaction to the presence of strange fibers in the thread can be brought about. The corresponding measures, such as stopping the spinning location, can be prevented in that undesirable components in the thread can be given attention. The already spun components can in this manner be eliminated.

Particularly advantageous is that the separation is essentially designed to be essentially at right angles to the separation. By this arrangement, the goal is fortunately achieved that the thread guide tube is particularly flexible in installation and the separation and reassembly can be done especially simply and quickly.

BRIEF DESCRIPTION OF THE DRAWINGS

In the following, the invention is described with the aid of drawings. There is shown in.

DETAILED DESCRIPTION

Figure 1:
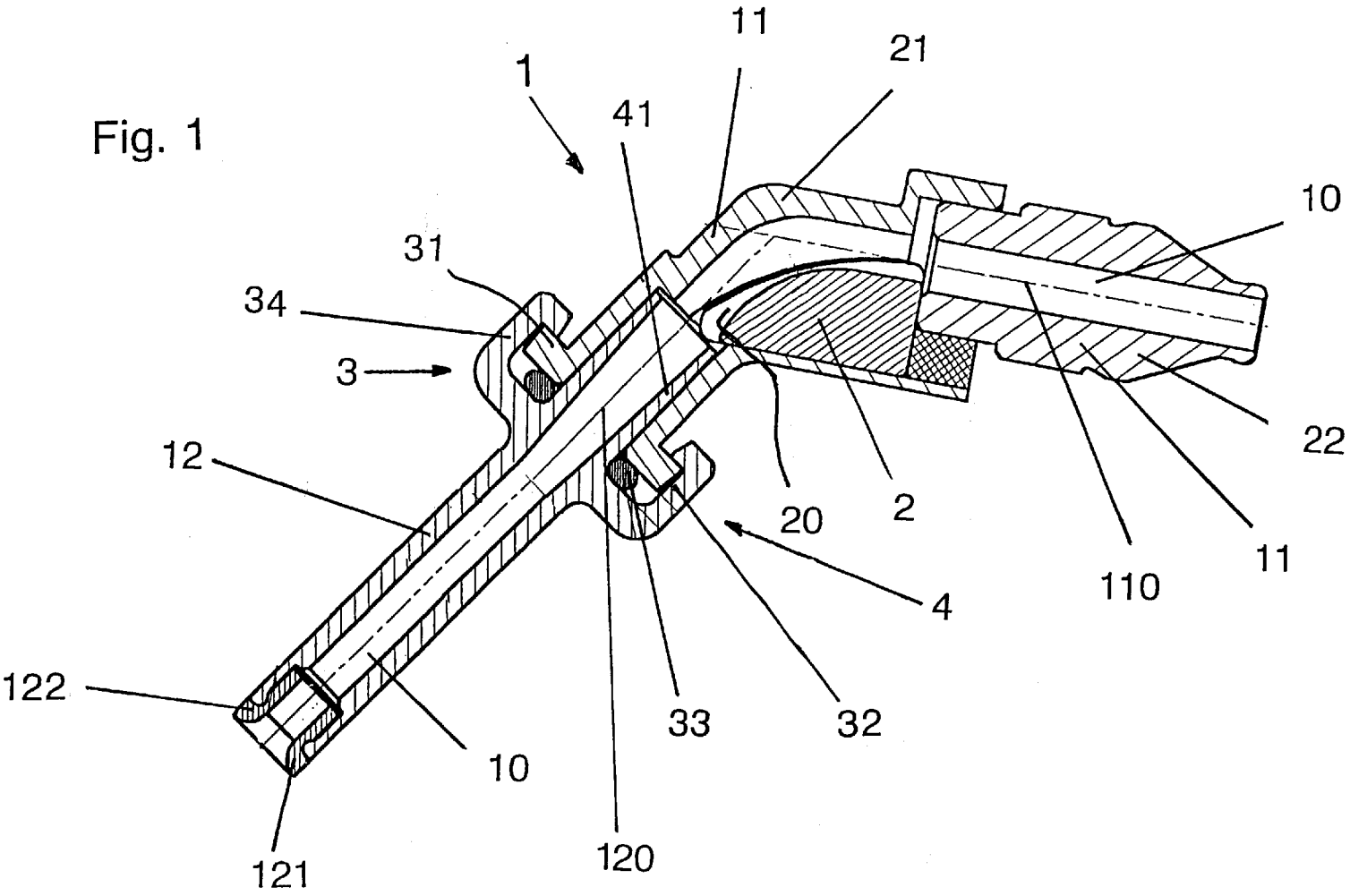
FIG. 1 in a sectional view, a thread guide tube designed in accord with the invention with a coupling in the area of that part of the thread guide tube which is remote from the thread forming zone, and FIG. 2 in partial section, a thread guide tube designed in accord with the invention similar to FIG. 1, with a sensor in the area of the thread guide tube which is remote from the thread forming zone.

Reference will now be made in detail to embodiments of the invention, examples of which are shown in the drawings. Each example is provided by way of explanation of the invention, and not meant as a limitation of the invention. For example, features illustrated or described as part of one embodiment may be used on another embodiment to yield still a third embodiment. These and other modifications and variations are within the scope and spirit of the present invention.

FIG. 1 shows a thread guide tube 1 in accord with the invention with a passage 10 for the guidance of a thread from the thread forming zone of a spinning machine, for instance out of the rotor of an open-end rotor spinning machine or a comparable apparatus such as a friction spinning machine. The thread guide tube 1 of FIG. 1 has a first section 11 which is proximal to the thread forming zone and a second section 12 which is remote from the thread forming zone. The spun thread enters in the area of the first section 11 into the passage 10 and runs therethrough to the tube end 121 of the second section 12. Next, the running thread, after leaving the thread guide tube 1, is clamped between two oppositely rotating rolls (not shown), so that with the aid of these so-called withdrawal rolls, the thread is pulled through the thread guide tube and out of the thread forming zone. Thus, the thread is drawn through the interior of the passage 10. The first section 11 of the thread guide tube 1 has a central axis 110, which closes an angle with the central axis 120 of the second section 12. This angle advantageously has a size in a range between 110° and 140°, preferably 125°. In the course of this transit through the passage 10, a thread led through the thread guide tube 1 makes a bend over the restraining element 2. This restraint is known to be advantageous for the formation of the thread. The thread moves over the surface 20 of the restraining element 2, whereby, the twisting, which was imparted in the thread forming zone, becomes consolidated which eases the thread formation. The restraining element 2 is firmly adhesively affixed in the first section 11. The first section 11 itself, originally comprises essentially two single pieces 21 and 22, which likewise are firmly bound to one another. As is known by the technology, they are adhesively bound together.

The thread guide tube 1 of FIG. 1 possesses in both of its sections 11 and 12, respectively, complementary parts of a coupling element 3. The two parts of the coupling element 3 so coact that the first section 11 and the second section 12 of the thread guide tube 1 can be tightly secured together, but yet can be released from one another.

The coupling element 3 is, in the first section 11, designed with an outside thread 31, while that portion of the coupling element 3 which is part of the second section 12 is designed with an inside thread. The threading of the coupling element 3 is thus designed as a two-way thread with such a pitch that only a twist of less than 90° is required in order to separate the two parts of the thread guide tube one from the other, or to bind them again together. The threading can also function in the manner of a bayonet closure. Between the two parts 31 and 32 of the coupling element 3, is to be advantageously found a packing 33 so that the coupling element 3, that is, its threads, cannot be contaminated. This contamination or dust is brought into the interior of the passage 10 of the thread guide tube 1 by the running thread therein and comprises essentially dust and fiber particles from abrasion.

The separation 4 of the thread guide tube 1 is formed in such a way that the first section 11 and the second section 12 partially telescope into one another. To serve this purpose, the first section 11 is provided with such an inside diameter, that it can receive therein a part 41 of the second section 12. The outside diameter of the part 41 of the second section is accommodatingly made so large that it makes a tight fit against the inside diameter of the of the section 11. That part of the first section which encompasses the part 41 of the second section 12, forms thus for the second section 12 a guide service which assures that in the passage 10 no offset arises so that the two parts can be always closed with parallel axes, allowing the run of the thread in the passage 10 not to be disturbed in its movement through the separation 4.

The separation 4 and its coupling element can be so designed that the outside thread is cut on the second section 12 and the inside thread is cut into the first section 11. There is no reason why the threading and the construction cannot be exactly reversed. Correspondingly, it is then possible that the second section 12 in the area of the separation 4 embraces the first section 11, thereby receiving the first section into its interior. Contrary to this, the construction as it is presented in FIG. 1, is advantageously so chosen because the second section can be more easily manipulated and demounted from the first section 11.

The first section 11, in this case can then remain undisturbed in the thread forming zone while the disassembly takes place. The enclosing collar 34 carrying the inner thread 32 offers then, because of its greater outside diameter, a better handgrip surface for the maintenance personnel or for appropriate gripping tools for the removal of the said second section 12 from the first section 11 of the thread guide tube 1.

Continuing in the extension of the thread guide tube 1, in thread movement direction, the second section 12 is formed as a straight, tubular component which exhibits on its termination 121 a ceramic insert 122, which is, for instance, adhesively affixed to the tube or simply clipped thereon. This ceramic insert 122 forms an abrasion protector for the end 121 of the second section 12 of the thread guide tube 1. With the availability of such an abrasion protective device, it becomes possible to construct the remainder part of the second section 12 completely out of plastic since the thread (not shown)running through the second section 12 does not, in general, contribute to abrasive wear.

In the area of the end of the second section 12 opposite from the ceramic insert 122, this section 12 advantageously possesses a passage 10 of a greater inside diameter, so that the thread entering from the first section 11 into the second section 12 does not touch the said second section 12. The passage 10 of the second section 12 practically possesses on the oppositely situated end 122 a kind of entry funnel, so that the run of the thread is not disturbed in the zone of transition at the separation 4. In this way, fortunately, no abrasion in the passage 10 of the second section 12 by the movement of the thread arises.

Besides the construction shown, in which the first section 11 and the second section 12 are joined together by a coupling element which exhibits a threaded connection, it is equally possible that the two can be fastened together by a snap connection. Moreover, it is equally possible to join the two sections by one or more screws.

Figure 2:
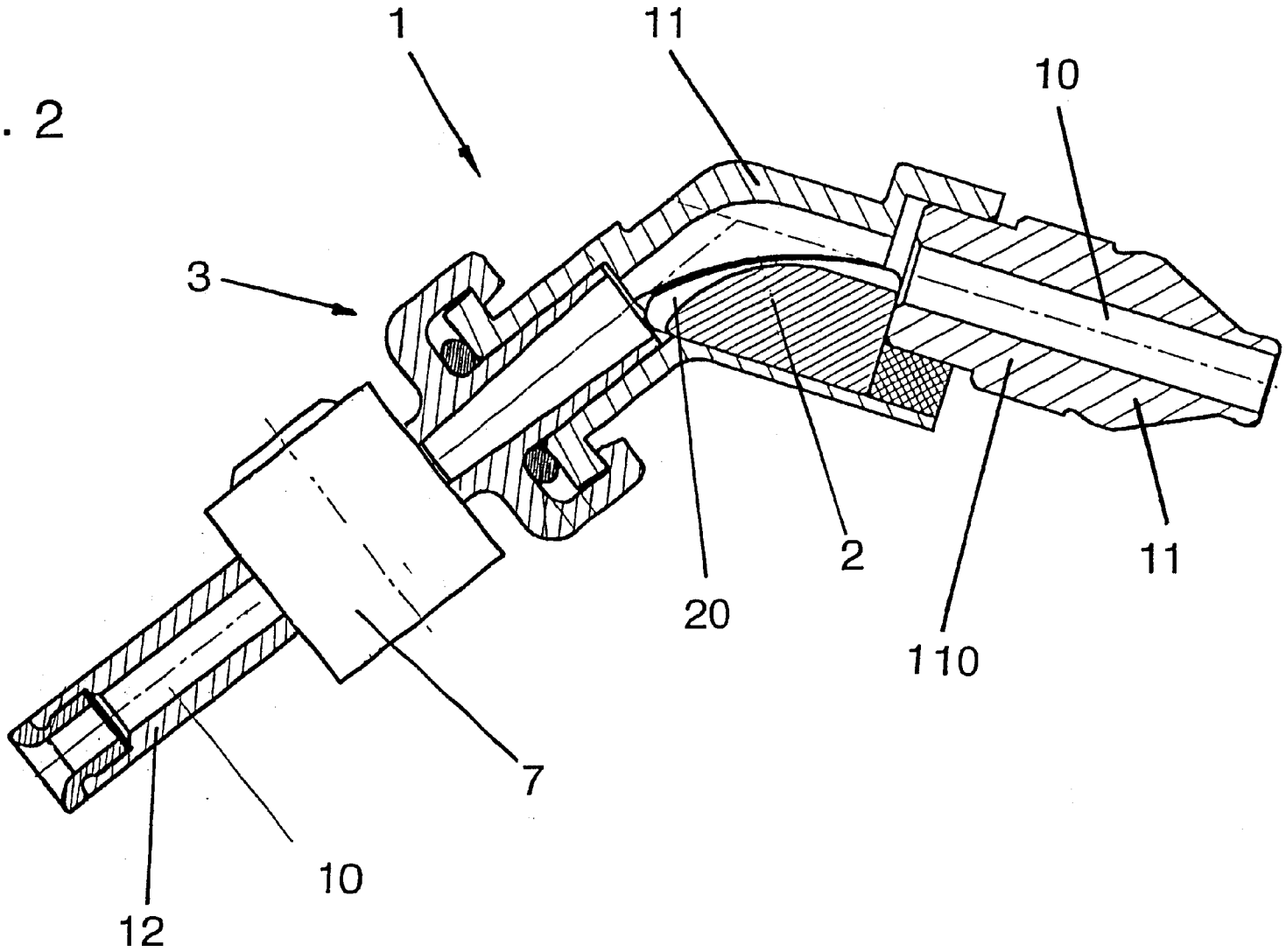

FIG. 2 shows an invented thread guide tube 1 similar to that of FIG. 1, with a sensor 7, which is placed in the area of the second section 12. The thread guide tube 1 of FIG. 2 is comprised likewise of a first section 11, which itself is composed of a plurality of individual parts which are combined together to form one section.

By means of the bushing 110, the thread guide tube 1 is inserted in a receiving boring (not shown) which holds the thread guide tube 1 onto the spinning machine. By appropriate fastening means, the thread guide tube 1 is secured by this receptacle. Directly on the said bushing 110 is placed a thread exit nozzle attached to, for instance, a rotor spinning machine, and which nozzle takes the thread out of the spin rotor and leads it into the thread guide tube 1. From the bushing 110 the thread runs in the passage 10 on through the thread guide tube 1. From the connection fitting to the thread guide tube 1, the thread runs generally free until, finally, it is wound on a spool. The thread guide tube 1 of FIG. 2 assures, because of its construction in accord with the invention, that the sensor 7 which is installed for the checking and monitoring of the thread, can be placed practically in the immediate vicinity of the thread forming zone, for instance, adjacent to the rotor of an open-end rotor spinning machine. Even while the thread is still in the thread guide tube 1, it is subject to the technical observation of the sensor 7.

From FIG. 2, one can also infer that by a disassembly of the second section 12 of the thread guide tube 1 at the same time the sensor 7 is also removed, while the first section 11 of the thread guide tube 1 can still remain in the spinning machine. By means of the invented construction of the thread guide tube 1 in accord with FIG. 2, the goal is also achieved that the thread in the immediate neighborhood of the thread forming zone can be already within the detection zone of the sensor 7 without having the arrangement of a sensor on the thread guide tube 1 impairing the flexible installation and construction of the same. Because of the independent construction of the second section 12 with the sensor 7 from the first section 11, the advantage is obtained that the spinning technology relevant parts of the thread guide tube 1, particularly the restraining element 2, can be designed independently of the sensor 7.

The remaining components of the first section 11, including the bushing 110 are not impaired, in general, by the sensor 7 or its presence. This is because the thread guide tube 1 of FIG. 2 is designed with a separation area in accord with the invention. Such construction permits the thread guide tube 1 to be separable and the different sections of the thread guide tube 1 to be independent, one of the other, and of independent design.

The second section 12 of the thread guide tube 1 is so designed in opposition to that shown in FIG. 1 that the sensing responsive element of the sensor 7 can also detect the thread running through the thread guide tube 1. This function is carried out in that:

a) the second section 12 is provided with an opening into which the sensing responsive element of the sensor 7 can gain access, or b) the second section 12 is interrupted in the direction of the thread movement, and in the area of this interruption, the second section construction is replaced by the sensor 7 itself.

Thus, correspondingly, a tube shaped part is included in the sensor 7 which conducts the thread through it and assures that the sensing element of the sensor 7 is exposed to the thread. The sensor 7 this way integrates itself with the second section 12, and in turn with the thread guide tube 1. If the second section 12 is separated by the sensor 7 in this way, then the two parts of the second section 12 are firmly affixed to the sensor 7, that is, by adhesive or they are connected by releasable bindings with the sensor 7. The sensor 7 can also be so designed that it forms the end 121 of the second section 12.

The sensor 7 can also, for instance, be that type of sensor which is capable of detecting the presence of a thread in the thread guide tube 1. This is necessary in order to control the spinning machine, i.e. the spinning station, to react correspondingly to the requirements of a thread break. Moreover, the sensor can be so designed that it is capable of monitoring the quality of the thread. For this purpose, the sensor would be provided with appropriate means which could evaluate the weight and/or the thickness of the thread.

This latter is carried out, for instance, by capacity measurement methods or by means of optical procedures.

In addition, is it particularly favorable to monitor the thread in the thread guide tube 1 to detect whether or not it contains the so called "foreign fibers". These are components that so alter the thread, particularly in appearance by color for instance, that the endproduct for which the thread is intended is not achieved. The transmission of the values determined by the sensor 7 is carried out, for instance, by a cable connected to a control unit.

Besides the above described sensors, the thread guide tube 1 made in accord with the invention can also be equipped with other devices or even operate simultaneously with a plurality of control or monitoring instruments.

Besides the embodiment forms shown in FIGS. 1 and 2 in which the invented separation is seen located in the direction of the thread travel after the change of direction by means of the restraining element 2, that is the bend in the thread guide tube 1, it is still within the framework of the invention to place the separation position in the first section 11 nearer to the thread forming zone and at the entry position of the thread into the thread guide tube 1. In this regard, it is entirely possible to adapt the bushing 110 correspondingly and to place the sensor 7 or the separable zone 4 before the restraining element 2. "Before" being in the sense of the direction of travel of the thread.

What is claimed is:

1. A thread guide tube with a passage for the guidance of a thread exiting a thread forming zone of a spinning machine comprising:

a first section which is proximal to the thread forming zone, said first section defining an essentially straight first thread axis;

a second section which is remote from the thread forming zone, said second section defining an essentially straight second thread axis that intersects and forms a non-zero angle with said first thread axis; and a coupling element operably configured between said first and second sections for releasable connection of said first and second sections so that said sections are separable and re-connectable with each other and connectable with different opposite respective said sections for maintenance and replacement.

2. A thread guide tube as in claim 1, wherein at least one of the first section and the second section of the thread guide tube is an enclosed tube.

3. A thread guide tube as in claim 1, wherein the coupling element comprises a bayonet or a clip connection.

4. A thread guide tube as in claim 1, wherein the coupling element comprises a threaded connection between the first and second sections.

5. A thread guide tube as in claim 1, further comprising a telescoping connection between the first and second sections at said coupling element.

6. A thread guide tube as in claim 1, further comprising a thread sensor configured on one of the first and second sections.

7. A thread guide tube as in claim 6, wherein the sensor is configured on the second section.

8. A thread guide tube as in claim 6, wherein the sensor comprises a sensing element disposed in the interior of the thread guide tube.

9. A thread guide tube as in claim 8, wherein the sensor monitors the presence of the thread in the passage of the thread guide tube.

10. A thread guide tube as in claim 6, wherein the sensor is designed for the monitoring of the characteristics of the thread running in the passage.

11. A thread guide tube as in claim 10, wherein the sensor monitors at least one of the thickness and the weight of the thread.

12. A thread guide tube as in claim 6, wherein the sensor is a sensor for the detection of foreign fibers in the thread.

13. A thread guide tube as in claim 1, wherein the first and second sections are separable along a plane that is generally perpendicular to an axis through the tube at the point of separation.

* * * * *